US005410989A

United States Patent [19]

Kendall et al.

[11] Patent Number: 5,410,989

[45] Date of Patent: May 2, 1995

[54] RADIANT CELL WATERTUBE BOILER AND METHOD

[75] Inventors: Robert M. Kendall, Sunnyvale; Richard L. Pam, Menlo Park; Andrew C. Minden; Nathan Saito, both of San Jose; James A. Gotterba, Santa Clara, all of Calif.

[73] Assignee: Alzeta Corporation, Santa Clara, Calif.

[21] Appl. No.: 78,552

[22] Filed: Jun. 16, 1993

[51] Int. Cl.[6] ..... F22B 23/06

[52] U.S. Cl. ..... 122/367.1; 122/18; 122/250 R

[58] Field of Search ..... 122/14, 18, 19, 248, 122/250 R, 235.11, 367

[56] References Cited

U.S. PATENT DOCUMENTS 4,089,303 5/1978 Brulfert ..... 122/250 R
4,519,770 5/1988 Kesselering et al. ..... 431/7
4,550,689 11/1985 Wolter ..... 122/18 X
4,658,762 4/1987 Kendall ..... 122/18 R
4,986,222 1/1991 Pickell ..... 122/6 R

*Primary Examiner*—4
*Assistant Examiner*—Denise L. Gromada
*Attorney, Agent, or Firm*—Flehr, Hohbach, Test, Albritton & Herbert

[57] ABSTRACT

A watertube boiler system is disclosed which provides a plurality of radiant burners mounted within a housing in parallel, spaced-apart relationship. Individual burners are encircled by heat cells comprised of watertube coils which are in tangential juxtaposed relationship achieving a high view factor to the burner surfaces. Premixed fuel and air combusts on the outer surfaces of the burners which radiate energy to the tubes forming the heat cells. The ratio of combustion surface area to heat cell volume is within an optimum range for minimizing NOX and CO emissions.

19 Claims, 4 Drawing Sheets

RADIANT CELL WATERTUBE BOILER AND METHOD

BACKGROUND OF THE INVENTION

1. Field of the Invention

This invention relates to apparatus and processes for generating hot water and/or steam for use in the petroleum, chemical, medical, food, heating, and other manufacturing and non-manufacturing industries. The invention has application in these industries for generation of process steam for hydrocarbon heating and petroleum refining, manufacture of chemicals and commercial food products, cleaning, laundries, and space heating.

2. Description of Related Art

For the generation of steam and hot water, almost half of all U.S. industrial watertube boilers are fired on natural gas. Within a specific industry, the chemical, petroleum refining, and food industries are the largest boiler users with over half of the energy consumed through the use of natural gas. In addition, due to current fuel pricing and emissions concerns, the demand for natural gas boilers is increasing. Heretofore these boilers have been a major source of NOX emissions. Within some areas having imposed NOX emission regulations, expensive postcombustion equipment must be installed which can double the cost of a new packaged watertube boiler.

At present most installed watertube boilers are fired by conventional burners of the diffusion flame type. The conventional diffusion flame burners in these boilers operate with relatively poor thermal uniformity and high noise output and develop undesirably large amounts of harmful emissions, particularly NOX and CO. To effectively reduce these emissions below 25 parts per million (ppm) requires complex downstream cleanup methods, such as Selective Catalytic Reduction. The need has thus been recognized to improve the thermal and emissions performance of these boilers by installing more efficient and cleaner operating radiant burners while maintaining cost competitiveness. For firetube boilers, radiant burners have been successfully employed based on the systems and methods of U.S. Pat. No. 4,519,770. No structural modification of the boiler was required to maintain the boiler's performance. No comparable method had been developed to introduce radiant burners into watertube boilers without major reductions in performance.

OBJECTS AND SUMMARY OF THE INVENTION

Accordingly, it is a principal object of the present invention to provide a new and improved watertube boiler system and method of operation for hot water and steam generation which obviates many of the disadvantages and limitations of existing watertube boilers.

Another object is to provide a watertube boiler system and method of the type described which operates with greatly reduced NOX (and CO) emissions and with less noise in comparison to conventional boilers of comparable ratings, and which eliminates the need for post-combustion cleanup equipment.

Another object is to provide a watertube boiler system and method which utilizes radiant burners to reduce NOX emissions in a fashion that effectively maintains or improves the output capacity and efficiency relative to those of conventional watertube boilers of similar dimensions.

Another object is to provide a boiler system and method which maximizes the radiant heat exchange from the burners to the watertubes, and which minimizes the view and subsequent heat transferred between burners, thus preventing localized destructive overheating and eliminating the need for zone-controlled burners.

The invention in summary provides a watertube boiler system and method of operation employing fiber matrix radiant burners which radiantly heat tube coils which contain water. The arrangement of the individual watertubes is such that each radiant burner element is substantially encircled by tube coils arrayed in a manner which forms individual heat cells. A stream of premixed fuel-air directed through the internal plenum of each burner flows outwardly through the matrix and stably combusts on the active surface to radiantly heat the tube coils.

DESCRIPTION OF THE PREFERRED EMBODIMENTS

Figure 1:
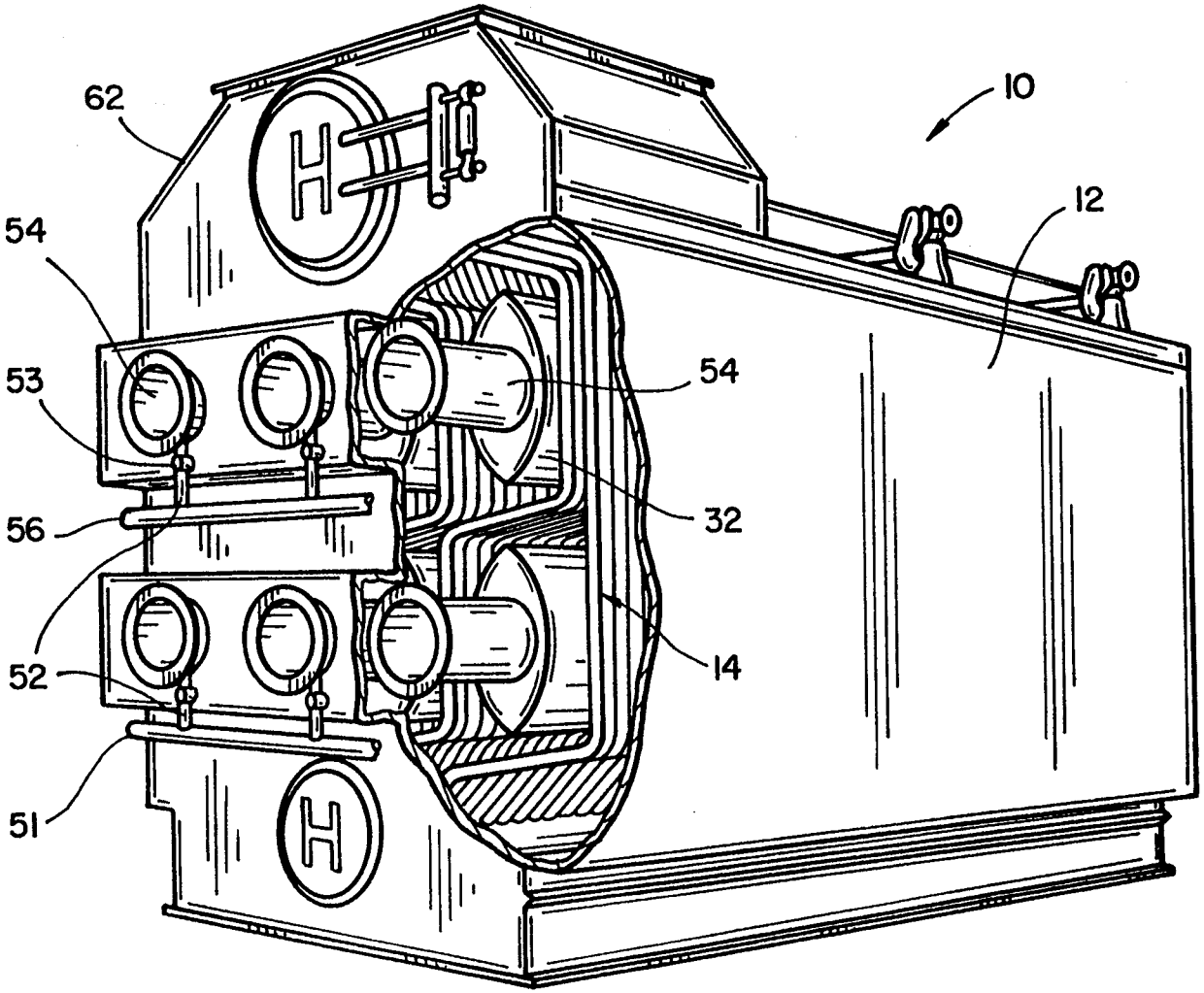
FIG. 1 is a perspective, partially broken away, view of a watertube boiler incorporating one embodiment of the invention.
Figure 3:
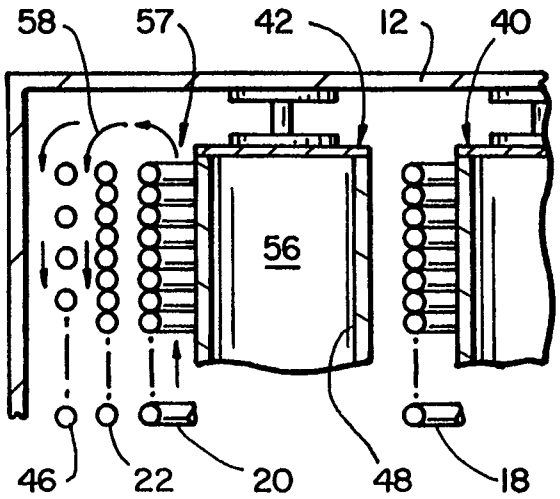
FIG. 3 is a fragmentary cross sectional view taken along the line 3—3 of FIG. 2.
Figure 2:
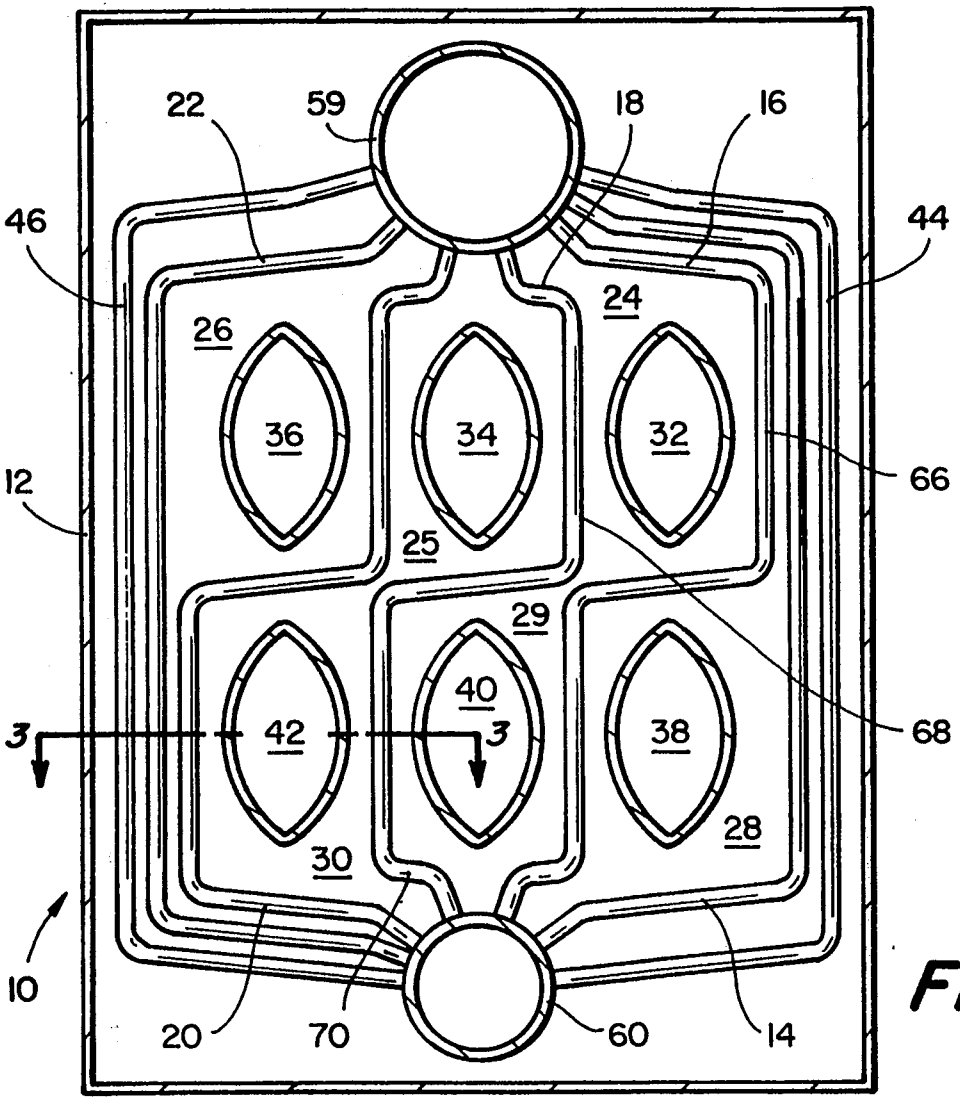
FIG. 2 is a vertical cross sectional view to an enlarged scale of the burner and watertube coil components of the embodiment of FIG. 1.

In the drawings, FIGS. 1–3 illustrate one embodiment of the invention providing a radiant cell watertube boiler 10. A boiler housing 12 contains five sets of watertube coils 14–22 shaped to form a plurality of heat cells 24–30, shown as six, which enclose respective radiant burners 32–42. The housing also contains two sets of convective coils 44 and 46, as shown in FIGS. 2 and 3 but omitted from FIG. 1 for purposes of clarity.

Radiant burners 32–42 are comprised of elongate hollow shells 48 which are mounted within the housing in horizontal, spaced-apart relationship, as shown in FIG. 3 for the typical burners 40 and 42. Each burner shell is comprised of a porous matrix of fibers which stably combust premixed gaseous fuel and air at the burner surface. Preferably the composition and method of formulation of the porous layer is by a vacuum-forming process (as described for example in U.S. Pat. No. 4,746,287) from a slurry composition of fibers, binding agents, catalysts and filler. Alternately, a sintered high temperature metal fiber mat composition, e.g. fabricated according to U.S. Pat. No. 4,597,734, may be employed.

Fuel, e.g. natural gas, is directed under pressure from manifolds 50, 51 through branch conduits 52 and fuel valves 53 leading into air inlet pipes 54 which connect into the upstream ends of the burners. Suitable blowers, not shown, force pressurized air into the air inlet pipes. The air/fuel mixture flows down the internal plena 56 of the burners and radially outwardly through the interstitial spaces between the matrix of fibers which form the burner shell where it ignites on the outer surface to stably combust. The burner surface incandescently glows and transfers heat primarily by radiation to the surrounding tube coils. Fuel control valves 53 are operated to provide firing rate and shut off control of individual burners.

Combustion exhaust gases flow toward the burner downstream ends along the circumferential spaces 57 which are formed between the burner surfaces and tube coils in the manner shown in FIG. 3. At the downstream end, the exhaust gases are turned along the path indicated by arrows 58 and directed toward the front of the boiler. The gases continue forward along and between convective tube coils 46 which are arrayed in spaced-apart relationship along the length of the gap between watertube coils 22 and the boiler housing. The ends of the convective tubes are connected with upper and lower drums 59, 60. The exhaust gases are then directed upwardly through cupola 62 at the front of the boiler and out through a stack, not shown. As desired, the convective coils could be eliminated so that the boiler operates in an all-radiant mode, or the exhaust gases could be directed to other heat recovery systems such as recuperative or superheat sections.

In the embodiment of FIGS. 1–3 the burners are arrayed in a matrix comprising an upper tier having the three burners 32–36 mounted in side-by-side relationship and a lower tier with the three burners 38–42 mounted below respective burners in the upper tier. Each burner is formed with an oblong cross section having its long axis upright.

The watertube coils which receive radiant heat from the burners are arranged in five sets of watertube coils 14-22 with each set having its watertubes extending parallel and tangentially contacting in side-by-side juxtaposed relationship. This juxtaposed relationship with no spacing between the watertubes provides maximum view factors to the burners, and also eliminates exchange of radiation between burners because they have no direct view of each other. In other embodiments, the watertubes may be spaced apart with axial fins attached to the tubes serving to span the space between the tubes.

The watertube coils sets extend along paths which form the walls of the heat cells 24–30, each of which forms a hollow core within which a respective burner is positioned. The coils of first set 14 extend first along horizontal paths shielded from burner 32 by the second coil set 16. The set 14 then extends downward, still shielded by set 16, until it forms the vertical outer wall of cell 28 containing burner 38. Finally this first set extends horizontally to the drum 60 and so forms the lower wall of cell 28. The coils of the second set 16 extend from the steam drum 59 along horizontal paths which form the upper wall of heat cell 24 spaced above the burner 32. The coil of this set then extends downwardly to form a vertical cell wall 66 which is laterally spaced outwardly from the burner. The watertubes of the second set then continues along a horizontal path to provide the lower wall of heat cell 24 and at the same time provide the upper wall of heat cell 28 for burner 38 in the lower tier. The watertube coils of the second set continue downwardly along a further vertical portion to form the inner lateral wall of heat cell 28, and thence along another horizontal portion into drum 60 to form a part of the lower wall of heat cell 29. The watertubes of third set 18 after first forming a portion of the upper wall of heat cell 25 as they extend horizontally from steam drum 59, then extend downwardly along a path to form an inner cell wall 68 laterally spaced from the burner. The cell wall formed by this portion of the third set also provides the wall of heat cell 25 which encloses burner 34. The third set of watertubes then continues along a horizontal path to provide the lower wall of heat cell 25 and at the same time provide the upper wall of heat cell 29 for burner 40 in the lower tier. The watertube coils of the third set continue downwardly along a further vertical portion to form a lateral wall of heat cell 29, and thence along another horizontal portion 70 into drum 60 to form a part of the lower wall of heat cell 29. The upper vertical portion of second coil set 16 shields radiation from burner 32 along the upper vertical portion of the first set 14.

The fourth set 20 of watertube coils extends from the upper steam drum along a short horizontal portion which forms a part of the upper wall of the heat cell 25. Set 20 then extends downwardly along a vertical portion which forms a wall separating heat cells 25 and 26. The fourth set then continues along a horizontal portion which forms a wall separating heat cell 26 from the heat cell 30 of burner 42 in the lower tier. The fourth set then continues downwardly along a vertical portion forming the outer wall of heat cell 30 in the lower tier, and then along a horizontal path forming the lower wall of this cell.

The fifth set 22 of watertube coils includes an upper horizontal portion which extends from steam drum 59 horizontally to form the upper wall of heat cell 26 and thence downwardly along an upper vertical portion which forms the outer wall of this cell. The lower portion of fifth coil set 22 is shielded from burner 42 by the lower vertical portion of the fourth set of coils 20.

Figure 4:
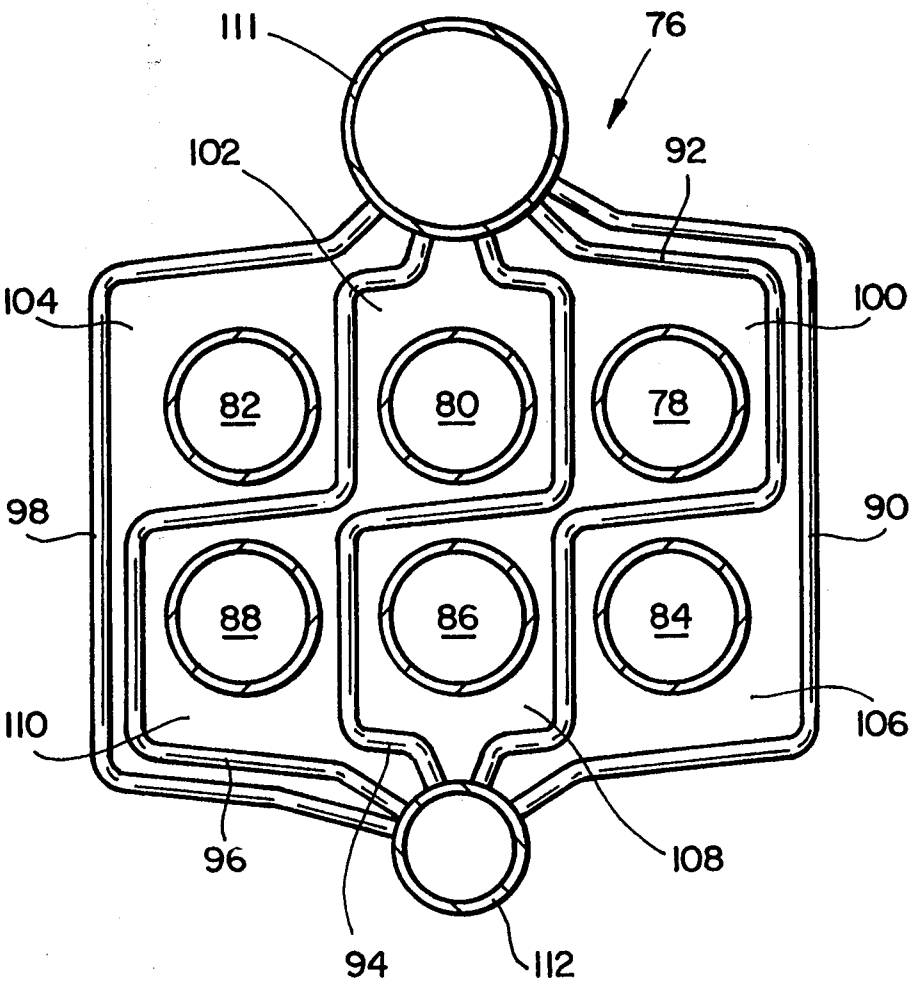
FIG. 4 is a vertical cross sectional view of the burner and watertube coil components according to another embodiment of the invention.

FIG. 4 illustrates another embodiment providing a watertube coil and burner system 76 similar to the embodiment of FIG. 2 but in which a matrix of six burners 78–88 of circular cross section are provided. The system of watertube coils and burners is mounted in a boiler housing similar to that described for FIG. 1.

In this embodiment five sets 90–98 of watertube coils are mounted in parallel, tangential contacting relationship. The coils are arrayed to form heat cells 100–110 having hollow cores of substantially square cross section for enclosing individual burners. Upper and lower drums 111, 112 connect with opposite ends of the coils.

Figure 5:
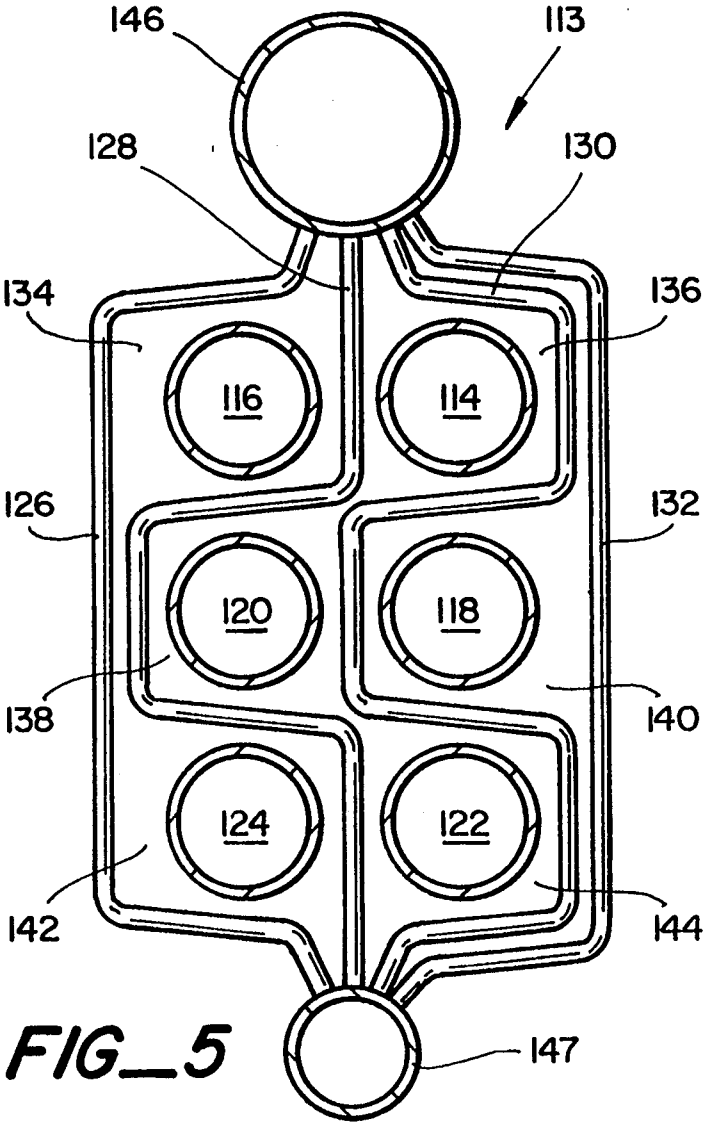
FIG. 5 is a vertical cross sectional view of the burner and watertube coil components according to another embodiment of the invention.

FIG. 5 illustrates another embodiment providing a watertube coil and burner system 113 for use with a matrix of six radiant burners 114–124 arrayed in three tiers. Two burners are laterally spaced apart in each tier, and each burner is of circular cross section. The watertube coils and burners are mounted in a suitable housing, not shown, similar to that described for the embodiment of FIG. 1.

In the embodiment of FIG. 5 the watertube coils are arranged in four sets 126–132, each set being comprised of parallel tubes which contact in tangential juxtaposed relationship. The coil sets form six heat cells 134–144 each of which enclose respective burners. Upper and lower steam drums 146, 147 connect with opposite ends of the coils.

First watertube coil set 126 includes a horizontal portion extending from upper steam drum 146 to form the upper wall of heat cell 134 enclosing burner 116 in the upper tier. The first set continues downwardly along a vertical portion which forms the outer wall of heat cell 134. The coils of first set 126 continue along a lower vertical portion which forms the outer wall of heat cell 142, and thence along a horizontal portion which forms the lower wall of this heat cell. The wall separating the heat cells 134 and 136 is formed by the upper vertical portion of second coil set 128. The second set continues along a horizontal portion which forms a wall separating heat cells 134 and 138. This coil set continues along a vertical portion which forms the outer wall of heat cell 138 in the middle tier. The second set continues along a horizontal portion which separates heat cells 138 and 142, and thence along a vertical portion which separates heat cells 142 and 144 for the burners in the lower tier.

The upper horizontal portion of third watertube coil set 130 forms the top wall of heat cell 136 for burner 114 in the upper tier. The third set continues along a vertical portion which forms the outer wall of this heat cell, and thence inwardly along a horizontal portion which forms a wall separating heat cells 136 and 140. The third set continues along a vertical portion forming a wall which separates heat cells 138 and 140 in the middle tier, and thence along a horizontal portion which separates burners 140 and 144. The third set continues along a downward portion which forms the outer wall of heat cell 144 and thence along a horizontal portion which forms the lower wall this cell.

The fourth set 132 of watertube coils includes an upper horizontal portion which is shielded from radiation from burner 114 by third set 130. The fourth coil set of continues downwardly along the three tiers, with only the portion 146 in the region of the middle tier forming an active heat cell wall along burner 118. The fourth set continues along a horizontal portion to lower steam drum 147, and this portion is shielded from the radiation of the burner by the third set.

Figure 7:
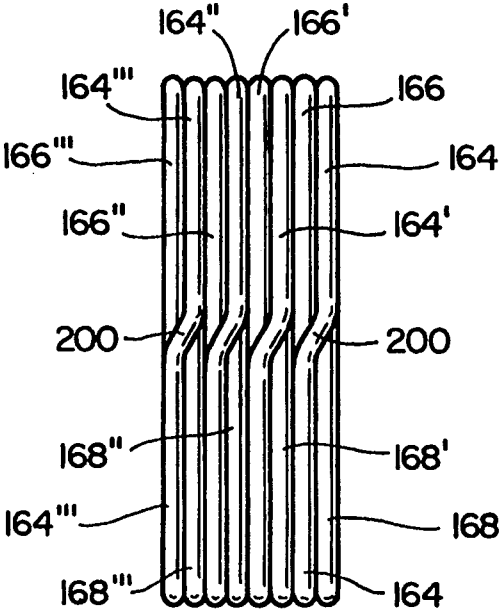
FIG. 7 is a side elevational view taken along the line 7—7 of FIG. 6.
Figure 8:
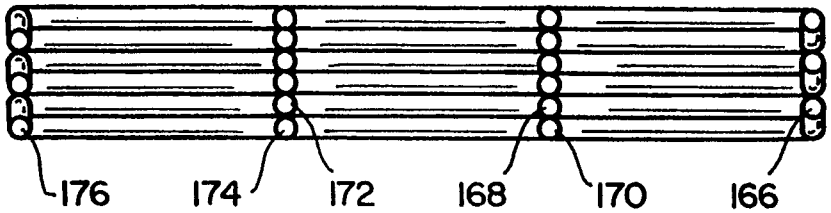
FIG. 8 is a horizontal cross sectional view taken along the line 8—8 of FIG. 6.
Figure 6:
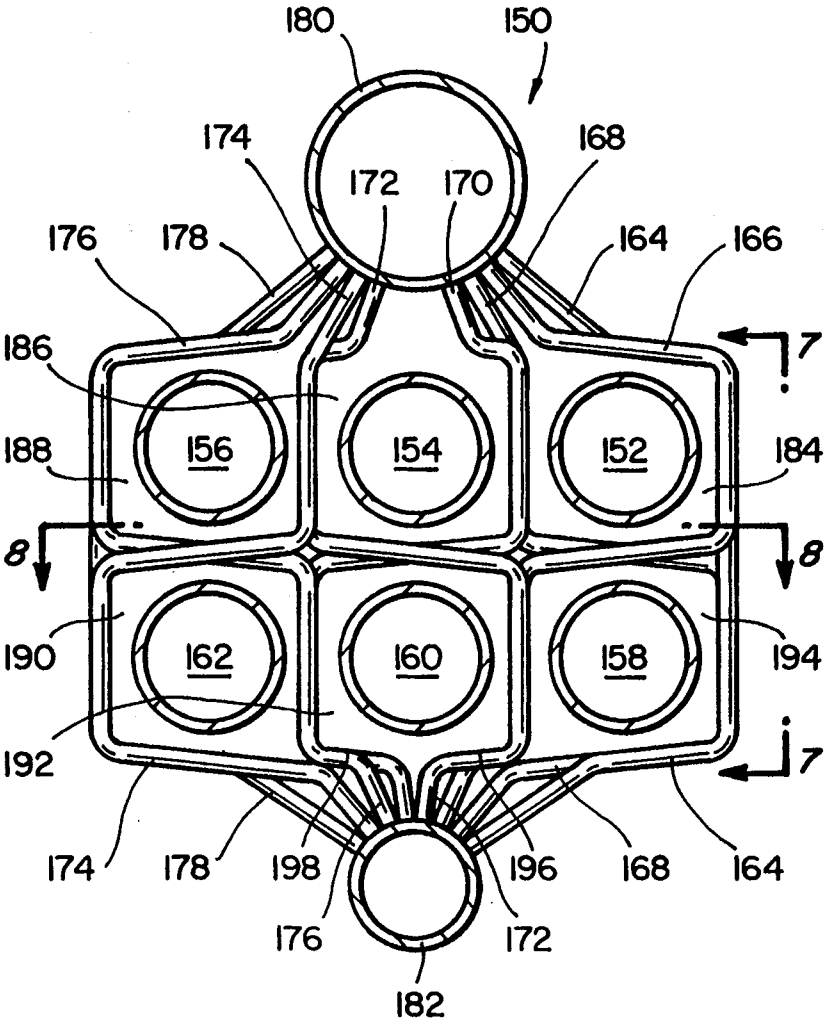
FIG. 6 is a vertical cross sectional view of the burner and watertube coil components according to another embodiment of the invention.

FIGS. 6–8 illustrates an embodiment providing a watertube coil and burner system 150 in which the watertubes are bent and interleaved in a manner so that all tube portions lying along the heat cell walls actively receive radiation and are not shielded from portions of other watertubes.

The watertube coil system 150 is mounted in a suitable boiler housing, not shown, in the manner described for the embodiment of FIG. 1.

A matrix of six radiant burners 152–162 of circular cross section are provided with three parallel burners in an upper tier and three parallel burners in a lower tier. The watertube coils are arranged in eight sets 164–178 which extend between an upper steam drum 180 and lower drum 182. The coil sets combine to form six heat cells 184–194 which enclose respective burners.

As best shown in FIGS. 7 and 8 first coil set 164 includes a series of parallel tubes which are laterally spaced apart a distance equal to the outer diameter of the tubes. The second coil set 166 includes an upper portion comprising parallel tubes which are laterally spaced apart and interleaved in the spacing of the first set so that the tubes of the first and second sets alternate and are tangentially juxtaposed in contact to form the upper wall of heat cell 184 which encloses burner 152. The first and second sets continue in their interleaved tangentially juxtaposed relationship downwardly along vertical portions which form a part of the outer wall of heat cell 184.

Third and fourth watertube coil sets 168 and 170 extend downwardly from steam drum 180. Each set includes spaced-apart tubes which are interleaved in tangentially juxtaposed relationship to form a vertical wall separating heat cells 184 and 186 which enclose burners 152 and 154 in the upper tier. Similarly, the fifth and sixth coil sets 172 and 174 extend downwardly and include parallel, spaced-apart tubes which are interleaved in tangentially juxtaposed relationship to form a vertical wall between the heat cells 186 and 188 enclosing burners 154 and 156 in the upper tier. Seventh and eighth coil sets 176 and 178 extend outwardly from the steam drum and include parallel, spaced-apart tubes which are interleaved in tangential juxtaposed relationship to form the upper wall of heat cell 188 enclosing burner 156. The coils of the seventh and eight sets continue downwardly along vertical portions to form the outer wall of this heat cell.

The remaining walls of the heat cells are formed by combinations of the coil sets arrayed in the following manner. The wall which horizontally separates top tier burner 152 from bottom tier burner 158 is comprised of the inwardly directed horizontal portions of second coil set 166 interleaved in tangentially juxtaposed relationship with the outwardly directed horizontal portions of third coil set 168. The outer vertical wall of heat cell 194 surrounding burner 158 is comprised of the lower portions of first coil set 164 interleaved with the downwardly extending portions of third coil set 168 (FIG. 7). The lower wall of heat cell 194 is comprised of the interleaved, inwardly directed horizontal portions of the first and third sets which connect into lower steam drum 182.

The wall which separates heat cell 186 enclosing upper tier burner 154 from the heat cell 192 enclosing lower tier burner 160 is comprised of inwardly directed horizontal portions of fifth coil set 172 which are interleaved with inwardly directed portions of fourth coil set 170. Similarly, the wall which separates the heat cells 188 and 190 enclosing respective burners 156 and 162 is comprised of the outwardly directed horizontal portions of the sixth coil set 174 interleaved with inwardly directed horizontal portions of seventh coil set 176.

The wall which separates the heat cells 192 and 194 which enclose burners 160 and 158 in the lower tier is comprised of downwardly directed portions of fifth coil set 172 which are interleaved with downwardly directed portion of second coil set 166. The second and fifth coil sets continue in parallel along lower horizontal portions 196 which extend along substantially one-half of the width of cell 192 where they are connected to the lower drum. Similarly, the wall which separates the heat cells 190 and 192 enclosing burners 162 and 160 in the lower tier is comprised of downwardly directed portions of fourth coil set 170 which interleave with downwardly directed portions of seventh coil set 176. The fourth and seventh sets continue inwardly along horizontal portions 198 for substantially one-half of the heat cell width where they are connected to the lower drum. These lower horizontal portions 196 and 198 provide the lower wall for heat cell 192.

As best illustrated in FIG. 7, the vertical segments of the first coil set 164 are formed with jog bends 200, at the midspan of their vertical lengths, so that each tube's centerline is displaced one tube width along the plane of the tubes. This displacement of the first set permits the interleaving in the plane of each tube run of the vertical portions of second coil set 166 as well as the vertical portions of third coil set 168. The eighth coil set 178 is similarly configured with respect to its interleaving between the sixth and seventh coil sets 174 and 176. In an alternate configuration (not shown) the first and eighth sets of coils can be omitted. To complete the outer walls of heat cells 188, 184, 190 and 194, fins (not shown) can be attached to the remaining tube coils on these wall to effectively close the space between tubes. Since heat is received by these coils from only one side, the reduction in flow capacity is appropriate.

In the invention the ratio of burner volume to heat cell volume (including the burner volume) is in the optimum range of 0.25 to 0.5 to achieve a compact boiler package. To realize the lowest emission of NOX consistent with efficiency, it is appropriate to maximize the burner surface area relative to the overall heat release rate. Ratios from 8 to 15 square feet of surface area per million British Thermal Units (BTUs) of heat release will result in NOX emission from about 25 parts per million (ppm) down to 5 ppm, respectively, when the products of combustion contain 3 to 5 percent Oxygen. This feature of the invention is achieved by maximizing the burner surface area relative to their volume. This in turn is achieved by maximizing the perimeter of the burners relative to their sectional area. Increasing the number of smaller diameter burners or using non circular cross-sections are typical procedures to achieve this object of the invention. The use of multiple burners enclosed by watertubes arrayed in the heat cells with maximum view factors achieves more heat release for the overall boiler size. As a corollary, for a given heat input there is a smaller heat release rate per burner.

One example of the use and operation of the invention is as follows. A watertube boiler similar in configuration to that described for the embodiment of FIGS. 1–3 is constructed with each of the six radiant burners 32–42 constructed of 5 segments with a total length of 210 inches and oval cross sectional dimensions of 39 inch long axis and 16 inches short axis. The volume of each heat cell 24–30 is 220 $ft^3$. The ratio of burner volume to heat cell volume is 0.33. Watertubes of 2 inch diameter are provided in each of the tube coil sets. Premixed reactants comprising air and natural gas fuel is supplied into the burners from air inlet pipes 54 under a pressure on the order of 2 inches of water and gas manifolds 50 and 51 under a pressure on the order of 3.5 psig. A pilot flame or other suitable means, not shown, is used to ignite the reactants on the outer surfaces of the burners, which incandescently combust giving a maximum heat input of approximately $50\times10^6$ Btu/hr. The combustion takes place stably along a shallow depth of the burners' surfaces, which reach an incandescent temperature on the order of 1,700° F. Thermal energy radiates to the tubes of the surrounding cell walls. The high radiant view factor from the invention achieves a high heat exchange efficiency. Exhaust gases flow along the core of the heat cells toward the rear of the boiler housing, where they reverse direction and flow toward the front in heat exchange relationship with convective tubes 44 and 46. Operation of this boiler at four different conditions produced the results shown in the table below.

| | Run Number | | | |
|---|---|---|---|---|
| | 1 | 2 | 3 | 4 |
| Number of burners operating | 2 | 6 | 6 | 6 |
| Boiler Firing Rate, $10^6$ BTUs/hour | 12.90 | 48.18 | 32.68 | 52.78 |
| Fired surface per million BTU/hour, $ft^2$ | 18.30 | 14.70 | 21.66 | 13.41 |
| Exhaust oxygen concentration, % | 12.3 | 7.2 | 7.4 | 6.4 |
| CO emissions, ppm @ 3% $O_2$ | 4.6 | 3.3 | 7.4 | 3.1 |
| NOX emissions, ppm @ 3% $O_2$ | 4.1 | 5.5 | 3.6 | 6.7 |

The radiant cell watertube boiler system of the invention provides a number of improvement and advantages. The cell arrangement for individual burners with the resulting low view factor between burners obviates the requirement for zone control radiant burner operation. In the prior art, where portions of radiant burners are in view of each other, then zone control can be achieved by means such as disclosed in Kendall et al. U.S. Pat. No. 4,664,620. Such zone control expedients are intended to prevent burner surface temperatures from being driven up to levels which increase NOX emissions, or which can be destructive of the burner material. In the invention the temperatures of the burner surfaces can be optimum without the requirement for zone control operation.

Another advantage in the invention is that the optimum ratio of combustion surface area to heat cell volume achieves lower NOX emissions relative to the heat release rate for overall boiler size.

A further advantage is the improved radiant section thermal efficiency as a result of the geometry which provides greater tube area surrounding the burners in comparison to conventional radiant burner designs.

Another important advantage from the present boiler design results from the uniform heat flux along the length of the heat cells. This permits uniform heating of the watertubes to increase thermal efficiency and watertube life.

Further advantages are that the watertube boiler system of the invention is more compact in size relative to conventional boilers adapted to low NOX radiant burners of comparable heat input ratings. Not only does this result in reduced steelwork and fabrication costs, but low NOX boilers of relatively large ratings can be shop fabricated and readily shipped on rail cars, which further reduces costs as compared to on-site boiler construction. A further advantage is that tubes which form the heat cells protect the burners from falling objects within the boiler, which would otherwise puncture the porous burner surfaces leaving them inoperable. Another advantage is that arrangements can be made to slide the burners in and out on tracks supported on the coils of the individual heat cells. The boiler design of this invention also permits the optional addition of recuperating and/or superheated coils according to the requirements and specifications of a particular application. A further advantage is that the burner design is easily scalable in size. Thus, additional burner segments can be added end-to-end with additional tube runs for increased heat input, as required by the particular application. Also additional heat cells can be created by other watertube arrangements. For example, a 4 by 3 cell configuration using somewhat smaller burners could increase the surface area for a fixed heater volume by 40%. This would permit a 40% increase in heat input with no increase in overall dimensions or emissions.

While the foregoing embodiments are at present considered to be preferred, it is understood that numerous variation and modifications may be made therein by those skilled in the art and it is intended to cover in the appended claims all such variations and modifications as fall within the true spirit and scope of the invention.

What is claimed is:

1. A watertube boiler system comprising a plurality of radiant burners oriented in side-by-side spaced-apart relationship, watertube means for directing water in heat exchange relationship with the burners, said watertube means including means for directing a first set of the watertubes along a first path and for directing a second set of the watertubes along a second path with portions of the watertubes along the first path being mounted in conjoint relationship with portions of the watertubes along the second path to form a plurality of heat cells, means for mounting the burners within the cells with only a single burner being positioned in a respective cell, and means for combusting premixed fuel and air on the outer surfaces of the burners for generating radiant and convective heat which is absorbed by the watertubes of the heat cells.

2. A watertube boiler system as in claim 1 in which the radiant burners are arrayed in a matrix comprising an upper tier of at least a pair of upper burners and a lower tier of at least a pair of lower burners, and said first set of watertubes along the first path forms at least a portion of an upper heat cell and said second set of watertubes along the second path forms another portion of said upper heat cell, and said first set of watertubes along the first path includes another portion forming at least a portion of a lower heat cell and the second set of watertubes along the second path forms another portion of the lower heat cell.

3. A watertube boiler system as in claim 1 in which the first set of watertubes along the first path forms at least a portion of a heat cell which separates a pair of said burners.

4. A watertube boiler system as in claim 1 in which certain said first set of watertubes along the first path are mounted in laterally spaced-apart relationship along at least one portion of a given heat cell, and certain of said second set of watertubes along the second path are mounted in laterally spaced-apart relationship and are also interleaved with said spaced-apart watertubes of the first set along said one portion to form said given heat cell.

5. A boiler of compact configuration for generating hot water or steam with improved thermal and exhaust emission performance comprising a boiler housing; watertube means for directing water into the housing along a heat exchange path; said watertube means comprising a coil of watertubes combined together to form a plurality of heat cells; the heat cells comprising cell means for arraying portions of the watertubes in tangentially juxtaposed side-by-side relationship to form cell walls which define elongate hollow cores within each heat cell; radiant burner means for generating radiant heat comprising a plurality of elongate cylindrical radiant burners; means for mounting the burners within the cores with only a single burner being positioned in a respective heat cell; said burners comprising outer combustion surfaces for stably combusting premixed fuel and for and fox directing radiant heat outwardly from the combustion surfaces; said cell walls being positioned in radially spaced relationship from said outer combustion surfaces of the burners for absorbing radiant heat therefrom; and means for orienting said cell walls in predetermined positions between separate burners within the housing for substantially shielding the transfer of radiant heat therebetween to minimize objectionable mounts of NOX emissions from the combustion.

6. A boiler as in claim 5 in which said cell walls substantially surround the combustion surfaces of the burners to absorb radiant heat flux from the burners which uniformly radiates to the cell walls along the length of the heat cells.

7. A boiler as in claim 5 in which the heat cells are oriented in parallel relationship within the housing.

8. A boiler as in claim 5 in which the watertubes which form the cell walls are arrayed parallel and in tangential juxtaposed relationship to maximize the radiant view factor of the burner combustion surfaces to the cell walls.

9. A boiler of compact configuration for generating hot water or steam with improved thermal and exhaust emission performance comprising a boiler housing; watertube means for directing water into the housing along a heat exchange path; said watertube means comprising a coil of watertubes combined together to form a plurality of heat cells; the heat cells comprising cell means for arraying portions of the watertubes in tangentially juxtaposed side-by-side relationship to form cell walls which define elongate hollow cores within each heat cell and in which the ratio of heat cell volume to combustion volume is in the range of 0.25 to 0.50; radiant burner means for generating; radiant heat comprising a plurality of elongate cylindrical radiant burners; means for mounting the burners within the cores of respective heat cells; said burners comprising outer combustion surfaces for stably combusting premixed fuel and air and for directing radiant hear outwardly from the combustion surfaces; said cell walls being positioned in radially spaced relationship from said outer combustion surfaces of the burners for absorbing radiant heat therefrom; and means for orienting said cell walls in predetermined positions between separate burners within the housing for substantially shielding the transfer of radiant heat therebetween to minimize objectionable amounts of NOX emissions from the combustion.

10. A boiler of compact configuration for generating hot water or steam with improved thermal and exhaust emission performance comprising a boiler housing; watertube means for directing water into the housing along a heat exchange path; said watertube means comprising a coil of watertubes combined together to form a plurality of heat cells; the heat cells comprising cell means for arraying portions of the watertubes in tangentially juxtaposed side-by-side relationship to form cell walls which define elongate hollow cores within each heat cell; radiant burner means for generating radiant heat comprising a plurality of elongate cylindrical radiant burners; means for mounting the burners within the cores of respective heat cells; said burners comprising outer combustion surfaces for stably combusting premixed fuel and air and for directing radiant heat outwardly from the combustion surfaces; said cell walls being positioned in radially spaced relationship from said outer combustion surfaces of the burners for absorbing radiant heat therefrom and in which the hollow cores are shaped to enclose substantially the entire outer combustion surface of the respective burner; and means for orienting said cell walls in predetermined positions between separate burners within the housing for substantially shielding the transfer of radiant heat therebetween to minimize objectionable mounts of NOX emissions from the combustion.

11. A boiler as in claim 10 in which said hollow cores have substantially rectangular cross sectional shapes with lateral cell walls on the long axes of the cores being disposed upright; and said radiant burners are elongated along said upright axes with the lateral sides of said combustion surfaces having radiant views facing the lateral cell walls.

12. A boiler as in claim 10 in which said hollow cores have substantially square cross sectional shapes with adjacent cell walls being oriented orthogonal; and said radiant burners are substantially circular in cross section with said combustion surfaces having radiant views facing the cell walls.

13. A boiler of compact configuration for generating hot water or stem with improved thermal and exhaust emission performance comprising a boiler housing; watertube means for directing water into the housing along a heat exchange path; said watertube means comprising a coil of watertubes combined together to form a plurality of heat cells; the heat cells comprising cell means for arraying portions of the watertubes in tangentially juxtaposed side-by-side relationship to form cell walls which define elongate hollow cores within each heat cell; radiant burner means for generating radiant heat comprising a plurality of elongate cylindrical radiant burners; means for mounting the burners within the cores of respective heat cells; said burners comprising outer combustion surfaces for stably combusting premixed fuel and air and for directing radiant heat outwardly from the combustion surfaces; said cell walls being positioned in radially spaced relationship from said outer combustion surfaces of the burners for absorbing radiant heat therefrom; and means for orienting said cell walls in predetermined positions between separate burners within the housing for substantially shielding the transfer of radiant heat therebetween to minimize objectionable mounts of NOX emissions from the combustion; at least a first heat cell enclosing one of said burners being disposed in vertically spaced relationship above a second heat cell enclosing another of said burners; said coil of watertubes which comprises the watertube means includes a first set of watertubes having vertical portions which extend along and form one lateral cell wall of the first heat cell; a second set of watertubes including first portions which vertically extend along and form in said first heat cell another lateral cell wall on the side thereof opposite said one lateral cell wall; and said second sat including second portions which horizontally extend along and form a common cell wall between said first and second heat cells.

14. A boiler as in claim 13 in which the first set of watertubes includes horizontal portions which extend along and form an upper cell wall over the first heat cell.

15. A boiler as in claim 13 which includes at least a third heat cell enclosing an additional one of said burners disposed in vertically spaced relationship below the second heat cell; said first set of watertubes includes additional vertical portions which extend along and form one lateral cell wall of the third heat cell; and said second set of watertubes includes third portions which horizontally extend along and form a common cell wall between said second and third heat cells; and said second set including fourth portions which vertically extend along and form in said third heat cell an additional lateral cell wall.

16. A boiler as in claim 15 in which the first set of watertubes includes first horizontal portions which extend along and form an upper cell wall over the first heat cell; and said first set including second horizontal portions which extend along and form a lower cell wall under the third heat cell.

17. A boiler of compact configuration for generating hot water or steam with improved thermal and exhaust emission performance comprising a boiler housing; watertube means for directing water into the housing along a heat exchange path; said watertube means comprising a coil of watertubes combined together to form a plurality of heat cells; the heat cells comprising cell means for arraying portions of the watertubes in tangentially juxtaposed side-by-side relationship to form cell walls which define elongate hollow cores within each heat cell; radiant burner means for generating radiant heat comprising a plurality of elongate cylindrical radiant burners; means for mounting the burners within the cores of respective heat cells; said burners comprising outer combustion surfaces for stably combusting premixed fuel and air and for directing radiant heat outwardly from the combustion surfaces; said cell walls being positioned in radially spaced relationship from said outer combustion surfaces of the burners for absorbing radiant heat therefrom; means for orienting said cell walls in predetermined positions between separate burners within the housing for substantially shielding the transfer of radiant heat therebetween to minimize objectionable mounts of NOX emissions from the combustion; at least a first heat cell enclosing one of said burners being disposed in vertically spaced relationship above a second heat cell enclosing another one of said burners; said coil of watertubes which comprises the watertube means includes a first set of laterally spaced-apart watertubes having first portions which vertically extend along and form a portion of one lateral cell wall of the first heat cell; said first set including second portions which horizontally extend along and form a portion of a common cell wall between the first and second heat cells; said first set further including third portions which vertically extend along and form a portion of one lateral cell wall of the second heat cell; a second set of laterally spaced-apart watertubes including first portions which vertically extend along and form another portion of said one lateral cell wall of the first heat cell, said first portions of the second set being interleaved with and tangentially juxtaposed against the first portions of the first set of watertubes; and second set including second portions which vertically extend along and form a portion of a lateral cell wail of the second heat cell on the side thereof opposite of said lateral cell wall formed by said third portions of the first set of watertubes.

18. A method of operating a boiler for generating hot water or steam with improved thermal and exhaust emission performance comprising the steps of combusting premixed fuel and air on the outer surfaces of a plurality of radiant burners for generating radiant heat; directing water through coils of watertubes which form a heat exchange path in the boiler; positioning the watertubes along a series of runs in a plurality of heat cells; positioning within the heat cells only a single one of said burners; positioning in side-by-side relationship adjacent watertubes in each heat cell to form cell walls about the respective burner; and radiating heat from the burners to the cell walls to heat water in the watertubes.

19. A method as in claim 18 including the steps of positioning at least two of the heat cells and their respective burners in adjacent relationship; orienting portions of said cell walls between the heat cells with the cell walls blocking transfer of radiant heat between the burners whereby the radiant view factor between the burner surfaces is minimal.

* * * * *